US006509818B2

(12) United States Patent
Van Zeeland

(10) Patent No.: US 6,509,818 B2
(45) Date of Patent: Jan. 21, 2003

(54) SMART OVERLAY FOR ELECTRICAL SWITCHING

(75) Inventor: Anthony J. Van Zeeland, Mesa, AZ (US)

(73) Assignee: Duraswitch Industries, Inc., Mesa, AZ (US)

( * ) Notice: Subject to any disclaimer, the term of this patent is extended or adjusted under 35 U.S.C. 154(b) by 0 days.

(21) Appl. No.: 09/827,502

(22) Filed: Apr. 6, 2001

(65) Prior Publication Data

US 2002/0145495 A1 Oct. 10, 2002

(51) Int. Cl.[7] ..... H01H 9/00
(52) U.S. Cl. ..... 335/207; 335/205
(58) Field of Search ..... 335/205–207; 200/5 A, 5 R, 159 B, 243, 275, 86 R, 152

(56) References Cited

U.S. PATENT DOCUMENTS 3,508,356 A * 4/1970 Ross ..... 40/152
3,965,599 A * 6/1976 Ebner ..... 40/152
3,987,259 A * 10/1976 Larson ..... 200/5 A
4,336,530 A * 6/1982 Koike et al. ..... 340/712
4,345,119 A * 8/1982 Latasiewicz ..... 200/5 A
4,499,343 A * 2/1985 Prioux et al. ..... 200/5 A
4,942,275 A * 7/1990 Addy et al. ..... 200/308

* cited by examiner

*Primary Examiner*—Lincoln Donovan
(74) *Attorney, Agent, or Firm*—Cook, Alex, McFarron, Manzo, Cummings & Melher, Ltd.

(57) ABSTRACT

A circuit element has a substrate with a set of spaced switch leads thereon and an overlay magnetically retained on the substrate with a shorting strap on the overlay in facing relation with the conductors of the substrate. The shorting strap is arranged to engage at intersection points at least two of the switch leads when the overlay is in place on the substrate to electrically connect the two switch leads. The shorting straps of different overlays are uniquely arranged to connect selected pairs of switch leads.

23 Claims, 2 Drawing Sheets

SMART OVERLAY FOR ELECTRICAL SWITCHING

BACKGROUND OF THE INVENTION

This invention relates generally to machine-human interfaces and in particular to an electrical circuit which is capable of readily altering the function of a switch. In certain machines it is desirable to have switch convey a selectable output to associated electronics. It is also desirable to create some sort of markings or indicia on the switch which will convey to the user what the presently selected output of the switch is.

By way of example, a beverage dispenser of the type commonly found in fast food establishments may have a plurality of spigots for dispensing different flavors of soft drinks. A switch is provided to actuate the appropriate valves to start and stop flow of flavored syrup and carbonated water to a selected spigot. Some label or indicia is placed on or near the switch to tell the user what flavor will be supplied if that particular switch is activated. There may be situations where the proprietor of the dispenser may wish to change the flavor supplied upon activation of a switch. For example, the supply of one flavored syrup may be exhausted. Rather than taking that switch and its spigot out of service or having customers suffer the frustration of futile attempts to obtain the exhausted flavor, the proprietor may prefer to change the switch and spigot to another flavor. To do this the signal obtained from the switch must control a different set of valves. Obviously this could be done by rewiring the switch to the new set of valves but the time, training and tools required to do so make this approach impractical. A simpler alternative would be to alter the character of the output from the switch and allowing external electronics to sense the altered signal and select the appropriate set of valves. At the same time, users have to be alerted to what the new flavor is, i.e, new indicia on or near the switch must be provided. The present invention provides a switch that accomplishes the foregoing.

SUMMARY OF THE INVENTION

This invention provides an electric circuit whose output can be readily altered. The circuit has a substrate that includes a magnet layer and an insulative switch layer laminated together. The exposed surface of the switch layer has a set of conductors disposed on it. The conductors define a plurality of switch leads which terminate at switch contacts. The switch leads extend onto a tail portion of the switch layer for connection to external electronics. An overlay is removably mounted on the substrate. The overlay comprises a decal, retainer plate and insulative shorting layer laminated together. The retainer plate is made of magnetic material. When the overlay is placed on the substrate the magnetic attraction between the magnet layer and the retainer plate will hold the overlay on the substrate. The exposed surface of the shorting layer has a set of conductors on it defining a shorting strap. The shorting strap may include one or more shorting pads which align with the switch contacts when the overlay is installed on the substrate. The shorting strap is arranged to engage at least two of the switch leads to electrically connect the two switch leads. Multiple overlays having different shorting strap configurations are provided to connect different pairs of the switch leads. The decal of the overlay may be suitable indicia on it to advise what output will result from the shorting strap arrangement on that overlay.

DETAILED DESCRIPTION OF THE INVENTION

Figure 1:
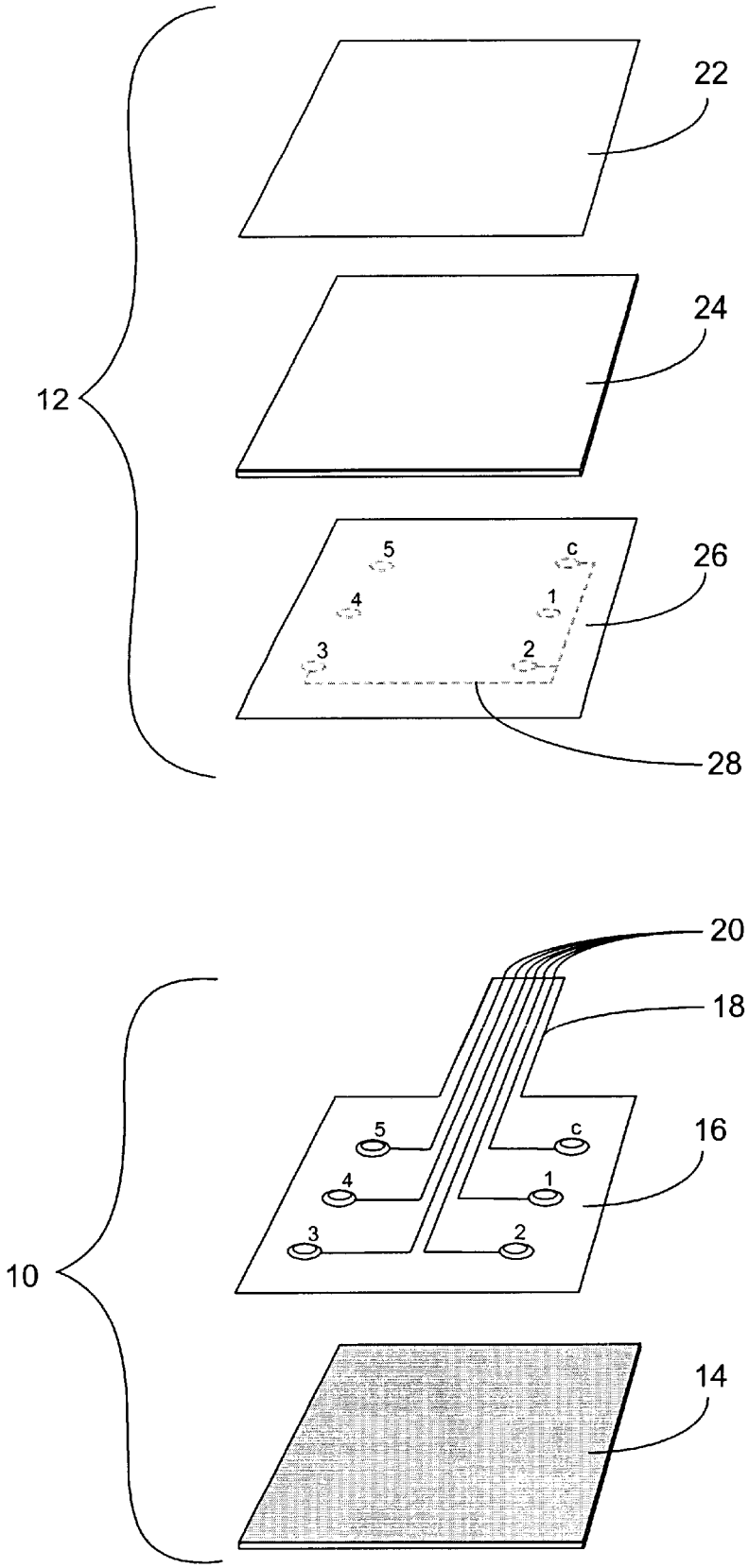
FIG. 1 is an exploded perspective view of an electrical circuit element having an overlay and substrate according to the present invention.

FIG. 1 illustrates the circuit element of the present invention. The circuit element has two main parts, a substrate 10 and an overlay 12. These parts are removably joined by an attachment element which in the illustrated embodiment is a magnetic connection. The substrate and overlay may each be laminated members whose components will now be described.

The substrate includes a magnet layer 14 and a switch layer 16. The magnet layer is preferably a sheet magnet as shown. The switch layer is made of electrically insulating material such as polyester. The switch layer 16 and magnet layer 14 are laminated together using suitable adhesives. The switch layer includes a tail portion 18 that extends beyond the magnet layer for connection to external electronics (not shown). An exposed first surface of the switch layer 16 has a first set of conductors formed thereon. The conductors may be formed using screen printing or other suitable techniques. The first set of conductors includes a plurality of switch leads 20 that are spaced apart from one another. The switch leads extend onto the tail 18 and well as on the main portion of the switch layer. The switch leads terminate at switch contacts labeled 1–5 and C. Contact C may be a considered a common contact. The switch contacts are raised above the surface of the switch layer to assure they make good contact with the overlay as will be described below. The upraised contacts can be formed by increasing the contacts' thickness by repeated screening passes or by embossing the switch layer from the bottom side behind the position of each switch contact. The laminating adhesive might also be relieved at the embossed locations to allow formation of a small bubble in the switch layer. The bubble would then function as a contact spring.

The overlay 12 in the illustrated embodiment is a triple layer laminate including a decal 22, a retainer plate 24 and a shorting layer 26. The decal is made of a durable material on which suitable indicia can be printed or otherwise formed to indicate to the user what the function of the switch is. Polyester is one possibility. In the example of the beverage dispenser the decal might bear indicia identifying the flavor of beverage that would result from usage of that particular switch. The retainer plate 24 is made of magnetic material. By magnetic material it is meant that the material is affected by a magnet. A thin sheet of steel would be suitable. The shorting layer 26 is similar to the switch layer 16 in that it is made of electrically insulating material and carries a second set of conductors on its first or exposed surface. In this case the second conductors include a shorting strap 28 screened onto the shorting layer. The shorting strap has enlarged areas which form shorting pads labeled 1–5 and C. The second set of conductors could be printed or otherwise formed on the shorting layer.

In the assembled state the overlay 12 is mounted on the substrate 10 with the first surface of the switch layer adjacent the first surface of the shorting layer. The overlay is held in position by the magnetic attraction between the magnet layer 14 and the retainer plate 24. The overlay is located so that the shorting pads are aligned with and in physical engagement with the switch contacts. This electrically connects at least two of the switch leads. In the illustrated embodiment the shorting strap 28 is arranged to electrically connect switch contacts 2, 3 and C and their associated leads. Note that only the switch leads that are connected by the shorting strap will form a part of the completed circuit.

Figure 2:
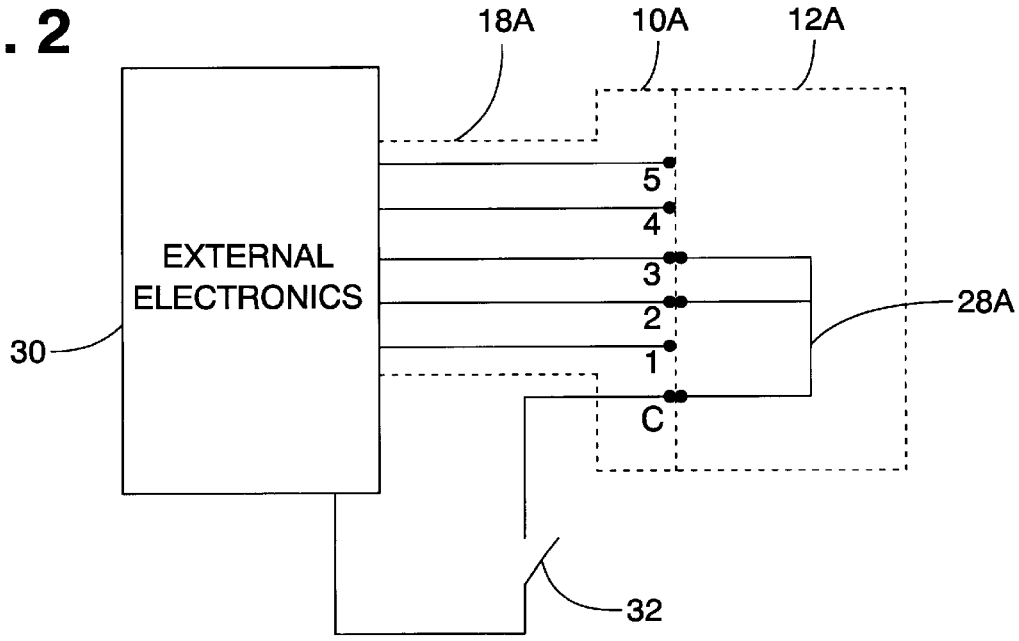
FIG. 2 is a circuit diagram of a typical electrical circuit in which the circuit element of FIG. 1 could be used, including a schematic representation of a substrate and a first overlay.
Figure 3:
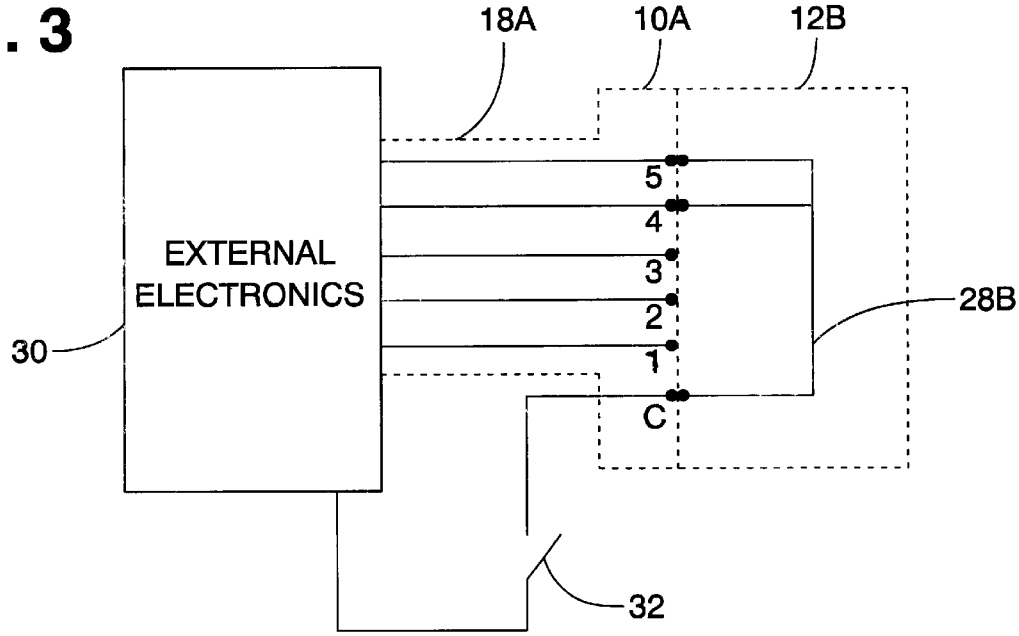
FIG. 3 is similar to FIG. 2 but with a second overlay.

When it is desired to alter the function of the switch, the first overlay is lifted off of the substrate and an alternate, second overlay would replace it. The second overlay has a different shorting strap arrangement that connects different ones of the switch leads. This concept is illustrated in the circuit diagrams of FIGS. 2 and 3. Here the external electronics are shown at 30. The external electronics supply the electrical signals on the switch leads. Typically the electronics will include a multiplexer or the like, a microprocessor and a suitable power source. A mechanical switch 32 is connected between the common lead C and the electronics 30. Switch 32 is what the user actuates. A substrate similar to substrate 10 is diagrammatically indicated at 10A with a tail 18A connected to the electronics 30. A first overlay is shown at 12A with a shorting strap 28A. It will be understood that while this circuit diagram shows the overlay 12A and substrate 10A side by side, in actuality they are one on top of the other as illustrated in FIG. 1. When a user actuates switch 32 it completes the circuit through the common lead and the electronics are able to sense that signals on leads 2 and 3 are connected to the common lead C. This will indicate a certain function is to be performed. To change that function the proprietor removes overlay 12A and replaces it with a second overlay 12B as shown in FIG. 3. The shorting strap 28B on second overlay 12B connects switch leads 4 and 5 to the common lead C. When switch 32 is actuated, the electronics module 30 will then recognize the return signals are coming through leads 4 and 5 instead of 2 and 3 and this indicates a different function is to be performed. In the example of the beverage dispenser the electronics will direct the opening of a different set of valves with the overlay 12B than would be the case with overlay 12A.

While the magnet and retainer plates are shown as full sheets that extend throughout the substrate and overlay, these elements could be localized to less than the full extent of the parts. It is preferable that a magnet and retainer plate be located in alignment with the switch contacts and shorting pads. This compresses the contacts and pads together to assure sound electrical contact. But other devices could be used to press the contacts and pads into engagement as well.

Alternate attachment elements could be used. For example, a bezel or frame could surround the periphery of the substrate and the edges of the overlay could fit under the bezel, either by sliding it in from an open side or by flexing the overlay and tucking its edges under the bezel. Alternately, the overlay might have folded over edges that fit around the edges of the substrate or into slots or connectors formed in the substrate. Snaps, clips, clamps, releasable adhesives or hook and loop fasteners such as Velcroe could also be used.

While a preferred form of the invention has been shown and described, it will be realized that alterations and modifications may be made thereto without departing from the scope of the following claims. For example, the locations of several of the parts could be reversed. The magnet could be on the overlay with the retainer plate on the substrate. Although it would not be as convenient to make connections to the external electronics, it would be possible to place the switch leads on the overlay with the shorting strap on the substrate. In that case the arrangement of the switch leads would have to be different for each overlay. Also, the substrate and overlay are not required to have the laminated construction shown. One or both of them might be formed of printed circuit board material with magnets and retainer plates embedded in or fixed thereto. One or both of the shorting layer and switch layer could be an insulative coating applied to the retainer plate or magnet layer. The decal could be deleted if the retainer plate is made of a material able to accept suitable indicia.

What is claimed is:

1. An electrical circuit, comprising:

a substrate including a first surface having a first set of conductors thereon;

an overlay including a first surface having a second set of conductors thereon;

an attachment element for removably mounting the overlay on the substrate with the respective first surfaces lying adjacent one another;

one of the first and second sets of conductors having a plurality of spaced switch leads and the other of the first and second sets of conductors having at least one shorting strap arranged to engage at intersection points at least two of the switch leads when the overlay is in place on the substrate to electrically connect said at least two switch leads.

2. The circuit of claim 1 wherein the attachment element comprises a magnet on one of the substrate and overlay and a retainer plate made of magnetic material on the other of the substrate and overlay, said retainer plate being aligned with the magnet when the overlay is in place on the substrate such that magnetic attraction between the magnet and retainer portion removably mounts the overlay on the substrate.

3. The circuit of claim 2 wherein the magnet and retainer plate are located in alignment with at least one of the intersection points.

4. The circuit of claim 1 wherein the switch leads terminate at switch contacts and the shorting strap includes shorting pads aligned with the switch contacts.

5. The circuit of claim 4 wherein the attachment element comprises a magnet on one of the substrate and overlay and a retainer plate made of magnetic material on the other of the substrate and overlay, said retainer plate being aligned with the magnet when the overlay is in place on the substrate such that magnetic attraction between the magnet and retainer portion removably mounts the overlay on the substrate and further characterized in that the magnet and retainer plate are located in alignment with at least one of the intersecting shorting pads and switch contacts.

6. The circuit of claim 2 wherein the magnet is coextensive with said one of the substrate and overlay.

7. The circuit of claim 2 wherein the retainer plate is coextensive with said other of the substrate and overlay.

8. The circuit of claim 2 wherein the overlay further comprises a decal layer.

9. The circuit of claim 2 wherein the overlay comprises a decal layer and a shorting layer laminated on opposite sides of the retainer plate.

10. The circuit of claim 2 wherein the substrate comprises a switch layer laminated to the magnet.

11. An electrical circuit for producing a selectable output to external electronics, comprising:

a substrate including a first surface having a first set of conductors thereon;

at least first and second overlays, each including a first surface, the first overlay having a second set of conductors on its first surface and the second overlay having a third set of conductors on its first surface;

an attachment element for removably mounting an installed one of the overlays on the substrate with the respective first surfaces lying adjacent one another such that the first set of conductors and one of the second and third sets of conductors define installed conductors;

one of the sets of installed conductors being connectable to said external electronics and having a plurality of spaced switch leads and the other set of installed conductors having at least one shorting strap arranged to engage at intersection points at least two of the switch leads when an overlay is in place on the substrate to electrically connect said at least two switch leads, the second and third sets of conductors being arranged to produce different outputs at the external electronics.

12. The circuit of claim 11 wherein the attachment element comprises a magnet on one of the substrate and the overlays and a retainer plate made of magnetic material on the other of the substrate and the overlays, said retainer plate being aligned with the magnet when the installed overlay is in place on the substrate such that magnetic attraction between the magnet and retainer portion removably mounts the installed overlay on the substrate.

13. The circuit of claim 12 wherein the magnet and retainer plate are located in alignment with at least one of the intersection points.

14. The circuit of claim 11 wherein the switch leads terminate at switch contacts and the shorting strap includes shorting pads aligned with the switch contacts.

15. The circuit of claim 14 wherein the attachment element comprises a magnet on one of the substrate and the overlays and a retainer plate made of magnetic material on the other of the substrate and the overlays, said retainer plate being aligned with the magnet when the installed overlay is in place on the substrate such that magnetic attraction between the magnet and retainer portion removably mounts the installed overlay on the substrate and further characterized in that the magnet and retainer plate are located in alignment with at least one of the intersecting shorting pads and switch contacts.

16. The circuit of claim 12 wherein the magnet is coextensive with said one of the substrate and overlays.

17. The circuit of claim 12 wherein the retainer plate is coextensive with said other of the substrate and overlays.

18. The circuit of claim 12 wherein each overlay further comprises a decal layer.

19. The circuit of claim 12 wherein each overlay comprises a decal layer and a shorting layer laminated on opposite sides of the retainer plate.

20. The circuit of claim 12 wherein the substrate comprises a switch layer laminated to the magnet.

21. The circuit of claim 11 wherein one of the substrate and overlays further comprises a tail which is connectable to the external electronics.

22. An electrical circuit, comprising:

a substrate including a magnet layer and an insulative switch layer laminated together and a first set of conductors on the switch layer, the first set of conductors having a plurality of spaced switch leads which are connectable to external electronics;

an overlay including a retainer plate made of magnetic material and an insulative shorting layer laminated together and a second set of conductors on the shorting layer, the second set of conductors having at least one shorting strap arranged to engage at intersection points at least two of the switch leads when the overlay is in place on the substrate to electrically connect said at least two switch leads, said retainer plate being aligned with the magnet when the overlay is in place on the substrate such that magnetic attraction between the magnet and retainer portion removably mounts the overlay on the substrate.

23. The circuit of claim 22 wherein the substrate further comprises a tail onto which the switch leads extend for connection to the external electronics.

* * * * *